US005912614A

United States Patent [19]

Yasuda et al.

[11] Patent Number: 5,912,614

[45] Date of Patent: Jun. 15, 1999

[54] VARIABLE RESISTER

[75] Inventors: Keiji Yasuda, Handa; Hisayoshi Okuya, Nishio, both of Japan

[73] Assignee: Aisin Seiki Kabushiki Kaisha, Kariya, Japan

[21] Appl. No.: 08/959,921

[22] Filed: Oct. 29, 1997

[51] Int. Cl.[6] ..... H01C 10/30

[52] U.S. Cl. ..... 338/160; 338/162; 338/160; 338/118

[58] Field of Search ..... 338/118, 160, 338/162, 167

[56] References Cited

FOREIGN PATENT DOCUMENTS 195 18 340 11/1995 Germany .
1-95602 6/1989 Japan .

*Primary Examiner*—Michael L. Gellner
*Assistant Examiner*—Richard K. Lee
*Attorney, Agent, or Firm*—Burns, Doane, Swecker & Mathis, L.L.P.

[57] ABSTRACT

A variable resister includes a housing made of a synthetic resin and having an inner space that opens to an open upper end of the housing, and a substrate made of a synthetic resin mounted on the housing for closing the open upper end of the housing to enclose the inner space. A resister is provided on the surface of the substrate and terminates in a conductive extremity while a conductive terminal electrically connected to a power supply terminates in an extremity that opposes the conductive extremity of the resister in the inner space. A conductive coil spring is elastically disposed between the conductive extremity of the resister and the extremity of the conductive terminal. A contact is disposed in sliding engagement with the resister such that a distance between the contact and the conductive extremity of the resister is used as a control variable.

20 Claims, 4 Drawing Sheets

VARIABLE RESISTER

FIELD OF THE INVENTION

The present invention generally relates to a resister. More particularly, the present invention pertains to a variable resister having a substrate provided with a resistive element which can be used, for example, as a throttle sensor, steering sensor or vehicle body height sensor in an automotive vehicle.

BACKGROUND OF THE INVENTION

A conventional variable resisters is disclosed in Japanese Utility Model Laid Open Print No. 1-95602 published without examination on Jun. 23, 1989. In this conventional variable resister, one end portion of a resistive element is electrically connected to an elastic end portion of a terminal to which electric current is applied from an exterior power source. The elastic end portion is formed in such a manner that one end portion of the terminal which is in the form of a metal or steel plate is curved into a quasicircular configuration. A similar type of structure is also disclosed in German Offenlegungsschrift No. 195 18 340 A1 published on Nov. 30, 1995.

In these types of conventional resisters, because one end portion of the terminal is in elastic engagement with the resistive element, the electric connection between the resistive element and the terminal is in the form of a line-to-surface contact. Thus, the electrical conductivity between the resistive element and the terminal becomes unstable when the device is mounted on an automotive vehicle body which is subject to vibration.

In addition, the foregoing curved structure or configuration of the terminal makes the spring constant of the curved end portion large and the elastic range of the curved end portion small. Thus, if one end portion of the steel terminal is curved excessively, the resultant end portion is of insufficient elasticity. Consequently, in extreme cases, it may not be possible to establish electrical contact between the terminal and the resistive element.

SUMMARY OF THE INVENTION

A need exists, therefore, for a variable resister that does not suffer from the foregoing drawbacks and disadvantages.

It would thus be desirable to provide a variable resister in which stable electrical contact can be established between one end portion of a steel terminal and a resistive element.

In accordance with the present invention, a variable resister includes a substrate made of synthetic resin, a resister provided on the surface of the substrate and terminating at a conductive extremity; a conductive terminal electrically connected to a power supply and terminated at an extremity opposed to the conductive extremity of the resister, and a conductive coil spring elastically disposed between the conductive extremity of the resister and the extremity of the conductive terminal. A contact is in sliding engagement with the resister such that the distance between the contact and the conductive extremity of the resister is used as a control variable.

In accordance with another aspect of the invention, a variable resister includes a substrate made of synthetic resin, a resister provided on the surface of the substrate, with the resister terminating at a conductive extremity, and a conductive terminal electrically connected to a power supply and terminating in an extremity that opposes the conductive extremity of the resister. An electrically conductive element extends between the conductive extremity of the resister and the extremity of the conductive terminal, with the electrically conductive element having oppositely located first and second end portions. At least one of the end portions of the electrically conductive element contacts either the conductive extremity of the resister or the extremity of the conductive terminal in a manner that provides a flat surface-to-flat surface contact. A contact is in sliding engagement with the resister such that the distance between the contact and the conductive extremity of the resister provides a control variable.

According to another aspect of the invention, a variable resister includes a housing having an open end, a substrate made of synthetic resin and mounted on the housing to close the open end of the housing, a resister provided on one of the surfaces of the substrate, with the resister terminating at a conductive extremity. A conductive terminal is electrically connected to a power supply and terminates in an extremity that opposes the conductive extremity of the resister, and an electrically conductive element extends between the conductive extremity of the resister and the extremity of the conductive terminal. The electrically conductive element has oppositely located first and second end portions, with at least one of the end portions of the electrically conductive element having a flat surface which provides flat surface-to-flat surface contact with either the conductive extremity of the resister or the extremity of the conductive terminal. A contact is in sliding engagement with the resister such that the distance between the contact and the conductive extremity of the resister provides a control variable.

BRIEF DESCRIPTION OF THE DRAWING FIGURES

The above features and characteristics associated with the present invention will be more apparent and more readily appreciated from the following detailed description considered with reference to the accompanying drawing figures in which like elements are designated by like reference numerals and wherein.

DETAILED DESCRIPTION OF A PREFERRED EMBODIMENT

Figure 1:
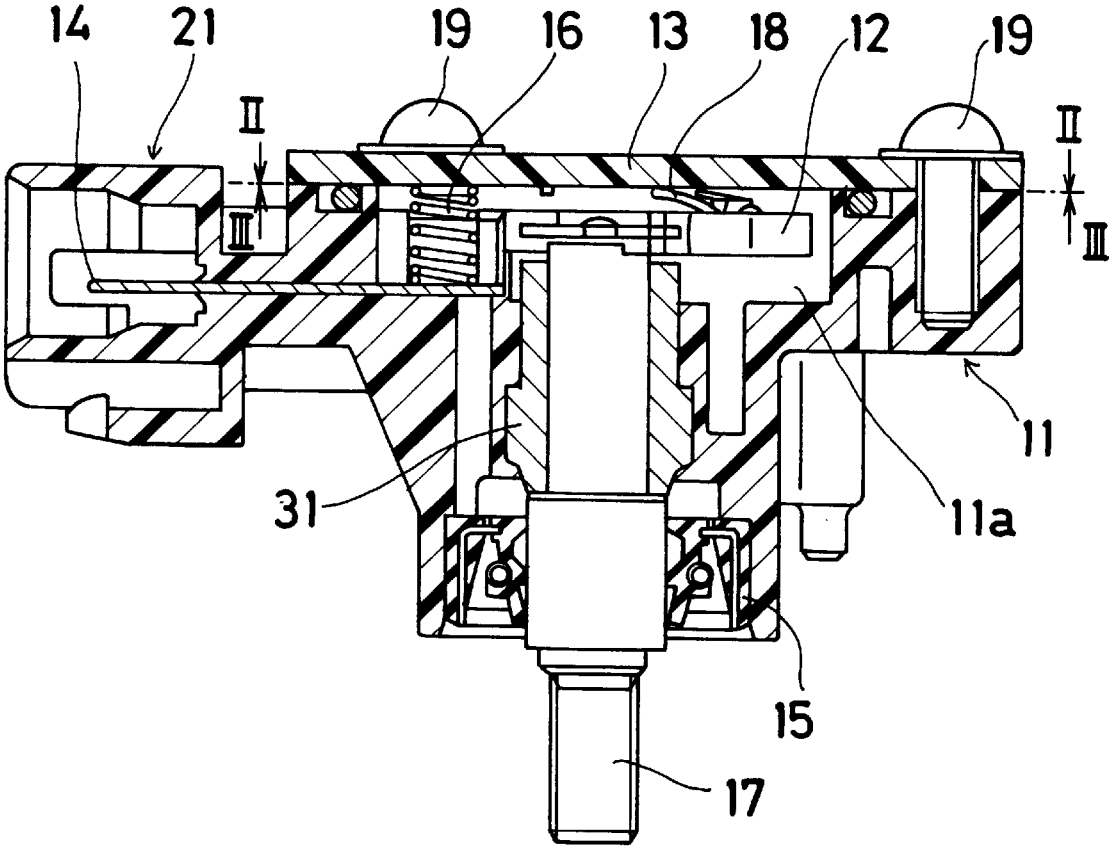
FIG. 1 is a cross-sectional view of an embodiment of a variable resister according to the present invention.
Figure 2:
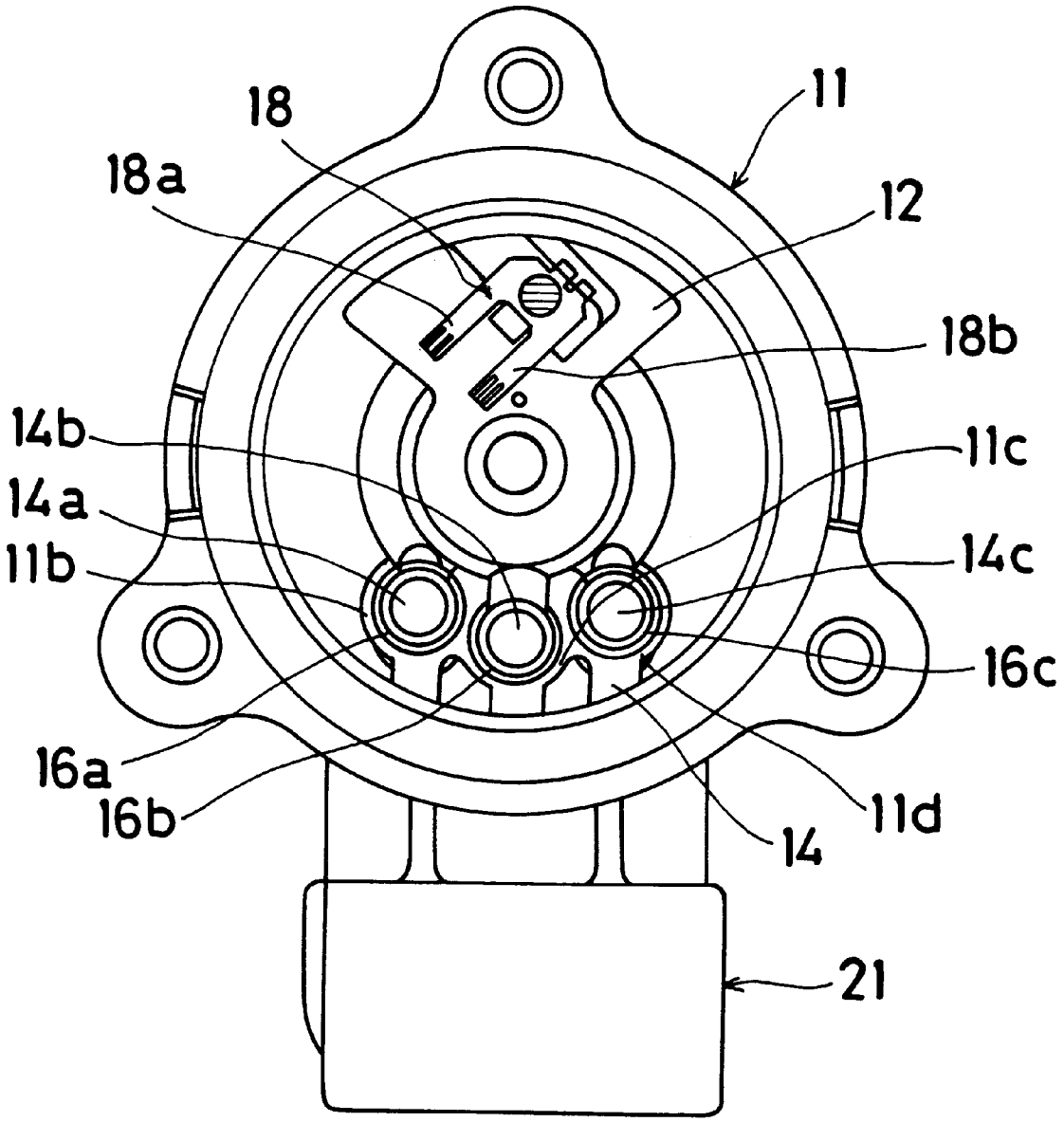
FIG. 2 is a plan view of a portion of the variable resister as seen from the direction of section line II—II in FIG. 1.

Referring initially to FIG. 1, the variable resister 10 according to the present invention includes a housing 11 made of a synthetic resin. A connector casing 21 is integrally formed with the housing 11 at one side of the housing (i.e., the left side as seen with reference to FIG. 1). Three terminals 14*a*, 14*b*, 14*c* which are made of metal or steel extend from the housing 11 into the connector casing 21.

The housing 11 possesses an open-end configuration and is provided with an inner space 11*a*. The inner space 11*a* opens towards the open upper end of the housing 11. The open upper end of the housing 11 is covered with a substrate 13 so that the inner space 11*a* in the housing 11 is enclosed.

The substrate 13 is made of a thermoplastic synthetic resin and is secured to the housing 11 by way of bolts 19.

Figure 3:
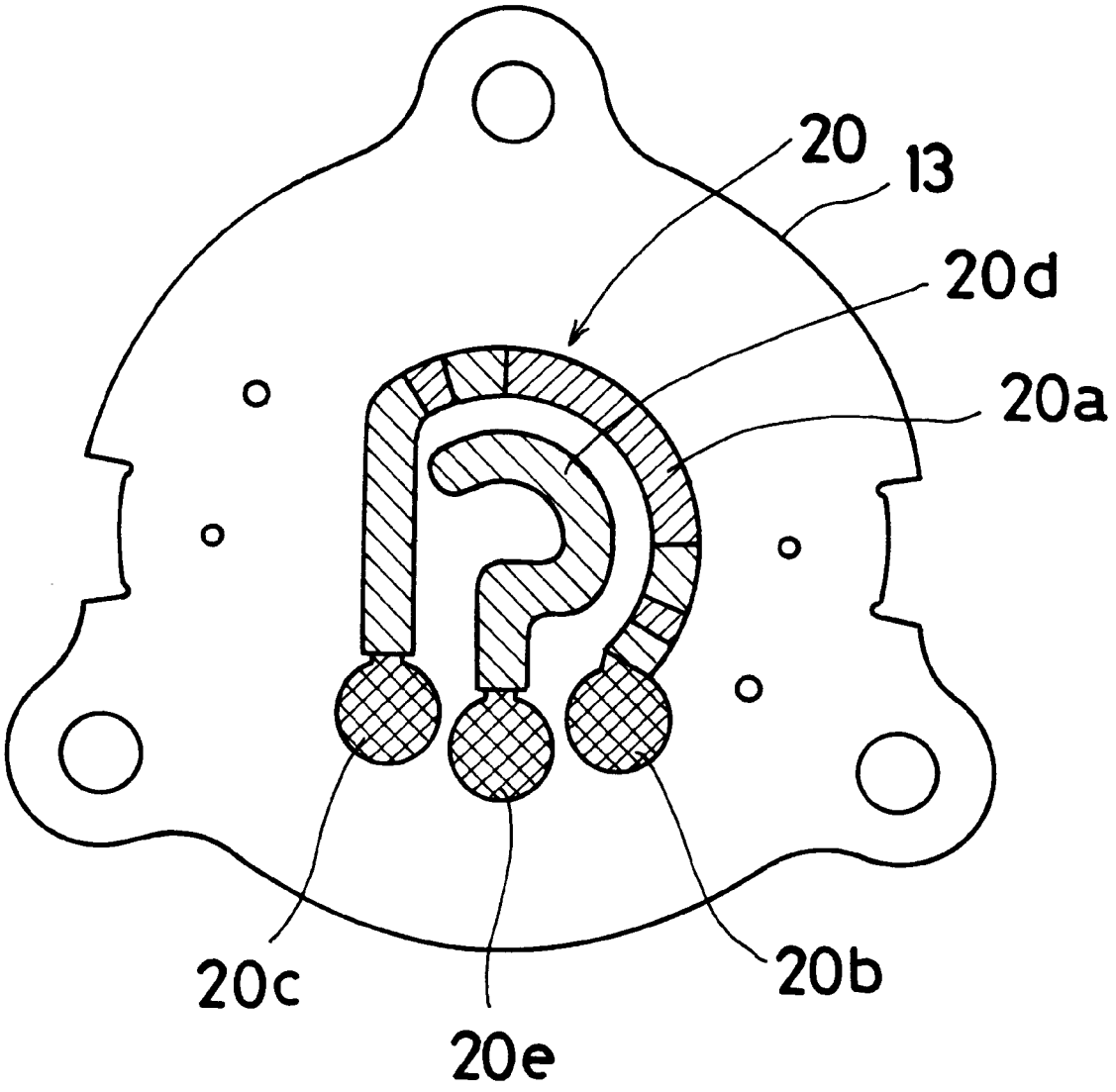
FIG. 3 is a plan view of a portion of the variable resister as seen from the direction of section line III—III in FIG. 1.

As seen in FIG. 3, a resistive member 20 is provided on the lower surface of the substrate 13. This resistive member 20 can be placed on the substrate 13 by way of a well-known screen printing technique. The resistive member 20 includes an arc-shaped resistive element 20*a* that acts as an electric resister and an arc-shaped conductive element 20*d* that is electrically isolated from the resistive element 20*a*. The resistive element 20*a* and the conductive element 20*d* have a common axis.

The resistive element 20*a* includes opposite ends, one of which terminates in a conductive extremity 20*b* and the other which terminates in a conductive extremity 20*c*. One end of the conductive element 20*d* (i.e., the end located closest to the conductive extremities 20*c*, 20*b*) terminates in a conductive extremity 20*e*.

Referring back to FIG. 1, a bush 31 is provided generally centrally within the housing 11 so that the axis of the bushing 31 is perpendicular to the lower surface of the substrate 13. A shaft 17 is rotatably mounted within the bush 31 and the upper end portion of the shaft 17 extends into the inner space 11*a* of the housing 11. A holder 12 is connected to the upper end portion of the shaft 17 and carries a brush 18. The brush 18 possesses a bifurcated configuration defined by spaced apart first and second portions 18*a*, 18*b*. The first portion 18*a* of the brush 18 is adapted to slidingly engage the resistive element 20*a* while the second portion 18*b* of the brush 18 is adapted to slidingly engage the conductive element 20*d*. A sealing member 15 for establishing a fluid-tight seal is disposed between the shaft 17 and the housing 11.

Cylindrical guide walls 11*b*, 11*c*, 11*d* are formed in the inner space 11*a* of the housing 11. The upper end of each of the guide walls 11*b*, 11*c*, 11*d* is open and spaced from and below the conductive extremities 20*b*, 20*c*, 20*e*. The lower end of each guide wall 11*b*, 11*c*, 11*d* is located proximate the end portion of one of the terminals 14*a*, 14*b*, 14*c*. The axes of the cylindrical guide walls 11*b*, 11*c*, 11*d* are oriented generally parallel to one another.

An electrically conductive element in the form of a coil spring 16*a*, 16*b*, 16*c* is positioned in each of the guide walls 11*b*, 11*c*, 11*d*, respectively. Each of the conductive coil springs 16*a* 16*b*, 16*c* is in elastic electrical connection with a respective one of the conductive extremities 20*b*, 20*e*, 20*c* and a respective one of the terminal 14*a*, 14*b*, 14*c*. The coil springs 16*a*, 16*b*, 16*c* are oriented parallel to one another.

Figure 5:
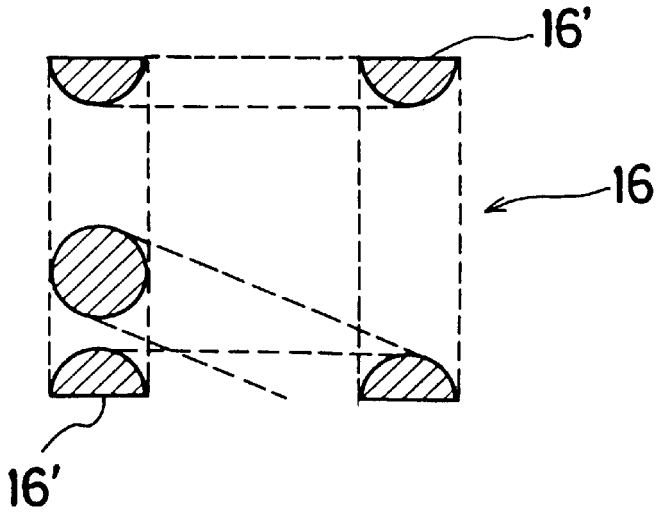
FIG. 5 is an enlarged cross-sectional view of both end portions of the coil spring used in the variable resister of the present invention.

As best shown in FIG. 5, both end portions of each coil spring 16*a*, 16*b*, 16*c* are configured to possess a semicircular cross-section. Thus, both ends of each of the springs 16*a*, 16*b*, 16*c* possess a flat or planar surface 16'. In this way, the ends of each spring are able to electrically contact the respective conductive extremity and the conductive terminal with a flat surface-to-flat surface contact. Such a planar surface-to-planar surface contact establishes sufficient conductive area between the respective conducting portions. In addition, each of the coil springs 16*a*, 16*b* and 16*c* is preferably plated along its entirety with gold. This helps to ensure that a reliable current is able to pass even if the current is weak or small.

Each of the coil springs 16*a*, 16*b*, 16*c* preferably has a spring constant of 1.18 N/mm. This relatively small spring constant provides a relatively wide spring range. Thus, even if the coil springs 16*a*, 16*b*, 16*c* are compressed excessively while being inserted in the respective guide walls, the coil springs 16*a*, 16*b*, 16*c* can be restored to the extent necessary to ensure an electrical connection between the terminals and the conductive extremities.

Figure 4:
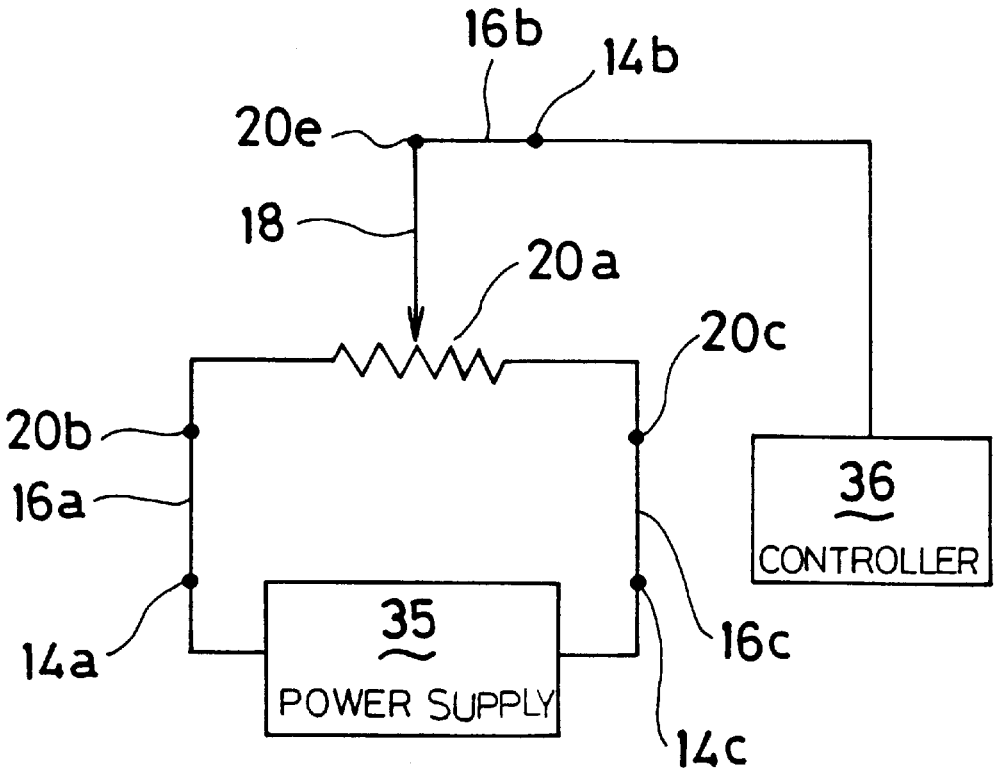
FIG. 4 is a schematic illustration of an electric circuit associated with the variable resister shown in FIG. 1.

FIG. 4 is an electrical diagram illustrating the features of the resistor. The circuit includes one end of an external power supply 35, the conductive terminal 14*a*, the conductive extremity 20*b*, the resistive element 20*a*, the conductive extremity 20*c*, the conductive terminal 14*b* and the other end of the outer power supply 35. The brush 18 which is rotated by the shaft 17 acts as a tap from the resistive element 20*a* and is set to input a signal to a controller 36 in such a manner that the inputted value depends on the angular position of the brush 18 on the shaft 17. When the shaft 17 is operatively connected to a throttle (not shown), the throttle opening is reflected as the angular position of the shaft 17 and is set to be inputted, as a control variable, to the controller 36. Thus, the distance between the contact 18 and the conductive extremity of the resister provided a control variable which is outputted to the controller 36.

It is to be noted that the variable resistor 10 can be associated with other devices. For example, when the shaft 17 is set to rotate in proportion to vehicle body height displacement, the variable resister 10 can represent such displacement as a control variable which is to be transmitted to the controller 36. The variable resister can also be used in contexts other than as a throttle sensor and a vehicle body height sensor. For example, the variable resister can be used as a steering sensor.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable resister comprising:

a substrate made of a synthetic resin and having a surface;

a resister provided on the surface of the substrate, said resister terminating at a conductive extremity;

a conductive terminal electrically connected to a power supply and terminating in an extremity that opposes the conductive extremity of the resister;

a conductive coil spring elastically disposed between the conductive extremity of the resister and the extremity of the conductive terminal for applying a spring force along an axial direction of the coil spring between the resister and the conductive terminal; and a contact in sliding engagement with the resister such that a distance between the contact and the conductive extremity of the resister provides a control variable.

2. A variable resister as set forth in claim 1, wherein the coil spring is plated with gold.

3. A variable resister as set forth in claim 1, wherein the coil spring has oppositely located first and second end portions, the first end portion of the coil spring being electrically connected to the conductive extremity of the resister and the second end portion of the coil spring being electrically connected to the extremity of the conductive terminal.

4. A variable resister as set forth in claim 3, wherein the first end portion of the coil spring possesses a surface configured to contact the conductive extremity of the resister along a flat surface-to-flat surface contact, and the second end portion of the coil spring contacts the extremity of the conductive terminal along a surface-to-surface contact.

5. A variable resister as set forth in claim 3, wherein the first and second end portions of the coil spring possess a flat configuration.

6. A variable resister as set forth in claim 5, wherein the first and second end portions of the coil spring possess a semi-circular cross-section.

7. A variable resister as set forth in claim 1, further comprising a housing made of a synthetic resin, said housing being open at one end and having an inner space that communicates with the open end of the housing.

8. A variable resister as set forth in claim 7, wherein the substrate is mounted on the open end of the housing for closing the inner space within the housing.

9. A variable resister comprising:

a substrate made of a synthetic resin, said substrate having opposite surfaces;

a resister provided on one of the surfaces of the substrate, said resister terminating at a conductive extremity;

a conductive terminal electrically connected to a power supply and terminating in an extremity that opposes the conductive extremity of the resister;

an electrically conductive element extending between the conductive extremity of the resister and the extremity of the conductive terminal, said electrically conductive element having oppositely located first and second end portions, at least one of the end portions of the electrically conductive element possessing a flat surface portion contacting one of the conductive extremity of the resister and the extremity of the conductive terminal in a manner that provides a flat surface-to-flat surface contact; and a contact in sliding engagement with the resister such that a distance between the contact and the conductive extremity of the resister provides a control variable.

10. A variable resister as set forth in claim 9, wherein the electrically conductive element is plated with gold.

11. A variable resister as set forth in claim 9, wherein the electrically conductive element is a coil spring, the first end portion of the coil spring being electrically connected to the conductive extremity of the resister and the second end portion of the coil spring being electrically connected to the extremity of the conductive terminal.

12. A variable resister as set forth in claim 9, including a housing that is open at one end, the substrate being mounted on the housing to close the open end of the housing, the housing including a guide wall in which the electrically conductive element is positioned.

13. A variable resister as set forth in claim 9, wherein the first and second end portions of the electrically conductive element possess a flat configuration.

14. A variable resister as set forth in claim 5, wherein the first and second end portions of the electrically conductive element possess a semi-circular cross-section.

15. A variable resister comprising:

a housing having an open end;

a substrate made of a synthetic resin, said substrate having opposite surfaces and being mounted on the housing to close the open end of the housing;

a resister provided on one of the surfaces of the substrate, said resister terminating at a conductive extremity;

a conductive terminal electrically connected to a power supply and terminating in an extremity that opposes the conductive extremity of the resister;

an electrically conductive element extending between the conductive extremity of the resister and the extremity of the conductive terminal, said electrically conductive element having oppositely located first and second end portions, at least one of the end portions of the electrically conductive element having a flat surface which provides flat surface-to-flat surface contact with one of the conductive extremity of the resister and the extremity of the conductive terminal; and a contact in sliding engagement with the resister such that a distance between the contact and the conductive extremity of the resister provides a control variable.

16. A variable resister as set forth in claim 15, wherein the electrically conductive element is a coil spring.

17. A variable resister as set forth in claim 16, wherein the housing is provided with a guide wall in which the coil spring is positioned.

18. A variable resister as set forth in claim 15, wherein the first and second end portions of the electrically conductive element possess a semi-circular cross-section.

19. A variable resister as set forth in claim 9, wherein the electrically conductive element is a coil spring.

20. A variable resister as set forth in claim 15, wherein the electrically conductive element is a coil spring.

* * * * *

UNITED STATES PATENT AND TRADEMARK OFFICE

CERTIFICATE OF CORRECTION

PATENT NO. : 5,912,614

DATED : June 15, 1999

INVENTOR(S) : YASUDA, et al.

It is certified that error appears in the above-indentified patent and that said Letters Patent is hereby corrected as shown below:

On the cover page, the following is added:

[30] Foreign Application Priority Data

Oct. 30, 1996 [JP] Japan ..... 8-288678 (P)

Signed and Sealed this

Thirteenth Day of March, 2001

*Attest:*

Nicholas P. Godici

NICHOLAS P. GODICI

*Attesting Officer*

*Acting Director of the United States Patent and Trademark Office*